United States Patent [19]

Hirao et al.

[11] Patent Number: 4,857,365

[45] Date of Patent: Aug. 15, 1989

[54] METHOD OF MANUFACTURING MODIFIED WOOD MATERIAL

[75] Inventors: Shozo Hirao; Hiroaki Usui; Yoshihiro Ohta; Takashi Nakai; Hiroyuki Ishikawa; Satoru Konishi, all of Kadoma, Japan

[73] Assignee: Matsushita Electric Works, Ltd., Osaka, Japan

[21] Appl. No.: 157,228

[22] Filed: Feb. 18, 1988

[30] Foreign Application Priority Data

| | | | |
|---|---|---|---|
| Feb. 24, 1987 | [JP] | Japan | 62-41704 |
| Apr. 24, 1987 | [JP] | Japan | 62-102311 |
| Nov. 24, 1987 | [JP] | Japan | 62-296434 |
| Nov. 26, 1987 | [JP] | Japan | 62-298174 |
| Nov. 26, 1987 | [JP] | Japan | 62-298176 |

[51] Int. Cl.[4] ..... B05D 3/00

[52] U.S. Cl. ..... 427/297; 427/342; 427/343; 427/440

[58] Field of Search ..... 427/297, 440, 342, 343

[56] References Cited

U.S. PATENT DOCUMENTS

| | | | |
|---|---|---|---|
| 55,216 | 0/1866 | Ransome | 427/297 |
| 756,173 | 3/1904 | Lihme | 427/297 |
| 1,076,553 | 10/1913 | Dautreppe | 427/297 |
| 1,216,729 | 2/1917 | Prince | 427/440 |
| 1,339,488 | 5/1920 | Weiss | 427/297 |
| 1,702,285 | 2/1929 | Vivas | 427/297 |
| 1,766,606 | 6/1930 | Coolidge | 427/440 |
| 1,768,175 | 6/1930 | Vivas | 427/297 |
| 1,769,983 | 7/1930 | Abrams | 427/297 |
| 2,838,424 | 6/1958 | Depew et al. | 427/297 |
| 2,919,971 | 1/1960 | Loetel | 21/7 |
| 4,731,265 | 3/1988 | Hirao et al. | 427/440 |

*Primary Examiner*—Janyce Bell

*Attorney, Agent, or Firm*—Burns, Doane, Swecker & Mathis

[57] ABSTRACT

A method of manufacturing a modifed wood material can fix within a raw wood material an insoluble, non-flammable inorganic compound with a highly efficient reaction achieved between cations and anions by sequentially immersing the raw wood material at least three times alternately in each of, and different one from that employed immediately before of a first water-soluble inorganic substance solution containing cations and a second water-soluble inorganic substance solution containing anions.

7 Claims, No Drawings

METHOD OF MANUFACTURING MODIFIED WOOD MATERIAL

TECHNICAL BACKGROUND OF THE INVENTION

This invention relates to methods of manufacturing modified wood materials and, more specifically, to a method of manufacturing a modified wood material by impregnating flammable natural woods with a non-flammable inorganic substance to render them highly durable.

The modified wood material having a high durability is useful because, when used as building materials, house interior finishing materials, furniture materials and the like, any fire occurring and spreading normally through the flammable woods can be remarkably suppressed and any attack by putrefactive bacteria, white ants or the like can be well avoided.

DISCLOSURE OF PRIOR ART

As a material simulative of wood grain surface to have woody appearance, there has been proposed a non-flammable board manufactured by mixing cement with wood fiber and setting the mixture. This board has been advantageous in its high non-flammability contributive to the suppression of fire spread, while disadvantageous in that the board has been lower in bending strength and workability than the woods and unsatisfactory in the wood grain simulation.

On the other hand, there has been suggested such a modified wood material that maintains a high bending strength, a fairly good workability and the woody appearance to keep the characteristics of woods effective. In this case, an attempt has been made to impregnate the woods with a non-flammable inorganic composition under predetermined conditions. However, this modified wood material has had a problem that, when the non-flammable inorganic composition is soluble in water, its use as the building material to be exposed to rain and snow causes the soluble composition to flow out of the modified material so as to render the material not to be effectively utilizable, and its use has had to be limited. When, on the other hand, the non-flammable inorganic composition is insoluble, there has been such a problem that the insoluble composition cannot be made to soak into the woods to the same extent as the soluble composition. This is considered to be due to the fact that the insoluble inorganic composition has usually a particle diameter of more than several $\mu$m whereas the wood texture has a pore diameter of about 0.1 $\mu$m at the narrowest part of the texture, that is, at a so-called pit membrane, and thus particles of the insoluble composition cannot be soaked into the wood texture.

Disclosed in U.S. Pat. No. 2,919,971 to Charles E. Loetel is an example of the modified wood material, which is designed not to have a fire retardant property but a rotproof property, and thus teaches a method of manufacturing a modified wood material comprising the steps of immersing a raw woods in a first solution of high concentration metallic salt sulfate such as $CuSO_4$ or $ZnSO_4$, preparing a second solution of soluble chromate, immersing the woods impregnated with the first solution into the second solution to have the first solution reacted with the second solution to have particles of the insoluble chromate sedimented from the second solution in the woods, and contacting a third zinc sulfate solution with the second solution excessively remaining in or on the woods until the third solution reacts with the remaining second solution. According to this Patent to Loetel, a cooling tower is made with use of the thus obtained modified wood materials, in which there may be provided a water resistance to some extent and eventually the rotproof property by means of the insoluble chromate particles sedimented in many fine pores in the surface of the woods to coat the woods with the insoluble chromate.

In the method of Loetel, however, there has been a defect that, as chromate or salt of copper is made to sediment in the woods, such sedimented inorganic salts cause the woods to be thereby colored and, in addition to that the inorganic salts are toxic, thus processed woods have been improper to be used as construction material.

In view of the above, Shozo Hirano et al have suggested in U.S. Pat. No. 4,731,265 assigned to the same assignee as in the present case, to solve the foregoing problems left unsolved by a method in which the wood material is immersed in a first bath of a water-soluble inorganic substance solution containing metallic ions showing insoluble and non-flammable, and then in a second bath of a water-soluble inorganic substance solution containing negative ions for causing the insoluble, non-flammable inorganic composition produced upon reaction with the metallic ions, so that the insoluble, non-flammable inorganic composition will be fixed within the wood material so as to provide it with excellent rotproof and mothproof properties, together with a high fire retardancy. With this method of manufacturing the modified wood of Hirano et al, it has been proved that the various problems involved in the modified wood according to the known methods have been eliminated and a satisfactorily high fire retardancy could be attained.

In the earlier invention of Hirano et al, on the other hand, there have been found a few problems, improvements in which respects of the method have been demanded, therefore. First, it is necessary to carry out a preliminary treatment of having the wood material saturated with water to be in a state of high water content, for example, more than 70%, so that the wood material can be sufficiently impregnated with water which acts as a medium carrying the ions for accelerating their diffusion, and then the wood material is immersed in a first bath, and in a second bath, upon which the reaction takes place not only inside the wood material but also in the second bath so that the insoluble, non-flammable inorganic composition will be produced also within the second bath, whereby the second bath is subjected to a contamination to render the bath not utilizable for repetitive use and the entire required amount of the solution for the bath is inherently increased. Further, when the wood material impregnated with the solution of the first bath is immersed in the second bath, the wood material is caused to be excessively impregnated with the solution of the second bath, and this is considered to be due to that the components of the solutions of the both baths which have reacted with each other for the sedimentation are no more contributive thereto and, accordingly, excessive amount of the second bath solution is made to supplementarily enter into the wood material. In this case, the processed wood material would be rather high in the susceptivity to water and moisture, rendering the surface of resultant modified wood to be sticky as if it is covered with an adhesive or, under a high moisture condition, to be in a state as if moistened, so as to be improper for being used as construction material.

TECHNICAL FIELD OF THE INVENTION

A primary object of the present invention is, therefore, to provide a method of manufacturing a modified wood material, the method allowing the modified wood material excellent in the rotproof and mothproof properties and high in the non-flammability to be manufactured at a high efficiency, while maintaining excellent appearance of wood.

According to the present invention, the above object can be attained by providing a method of manufacturing a modified wood material in which at least two different water-soluble inorganic substance solutions one of which containing cations and the other of which containing anions which produce insoluble, non-flammable inorganic compound upon reaction with the cations are prepared, a raw wood material is immersed in one of the two different water-soluble inorganic substance solutions, the material impregnated with the said one of the water-soluble inorganic substance solutions is then immersed in the other solution, and the said insoluble, non-flammable inorganic compound is thereby produced and fixed within the wood material with cations and anions reacted with each other, wherein the immersing of the wood material is sequentially carried out at least three times sequentially into different one of the water-soluble inorganic substance solutions from the other employed in immediately previous immersing.

Other objects and advantages of the present invention shall be made clear in the following description of the invention detailed with reference to respective examples described later.

The term "flame retardant" herein used means that impregnation of the high proportion of non-flammable inorganic composition in a flammable material enables the flaming of the material to be remarkably suppressed though causing a pyrolysis, that is, the flammable material can have a so-called self-extinguishing property.

The term "modified" refers to a provision to an originally flammable wood material a flame retardant property to such an extent that the modified wood can be officially approved at least as a quasi-non-flammable material in accordance with, for example, JIS (Japanese Industrial Standard), and further desirably to providing a dimensional stability and rotproof and mothproof properties.

The term "wood material" refers to a wide range of wood materials which include raw wood logs, sawn wood articles, sliced veneers, plywoods and so on which are effectively used as building materials, house interior finishing materials, furniture materials, and the like.

While the present invention shall now be described with reference to the preferred examples disclosed, it should be understood that the intention is not to limit the invention only to the particular examples disclosed but rather to cover all alterations, modifications and equivalent arrangements possible within the scope of appended claims.

DISCLOSURE OF PREFERRED EMBODIMENTS

In the present invention, at least two different water-soluble inorganic substance solutions each containing cations or anions are prepared, and a raw wood material is immersed alternately in each of these solutions respectively having each of the different ions and at least three times in such a sequence as, when the solution containing cations is represented by CIS whereas the other solution containing anions by AIS, then CIS→AIS→CIS or repetition thereof or AIS→CIS→AIS or repetition thereof, through which repetitive immersing a larger amount of insoluble, non-flammable inorganic compound is produced, diffused and fixed within the wood structure due to that, in the case of, for example, CIS→AIS→CIS, excessive anions will remain after reaction between cations and anions upon second immersing, and such excessive anions repeat the reaction with cations upon third immersing, whereby a modified wood excellent in the rotproof and mothproof properties and high in the fire retardancy can be manufactured.

As the insoluble, non-flammable inorganic compound to be fixed as diffused within the wood material, there may be enumerated such compounds as borate, phosphate, hydrogenphosphate, carbonate, sulfate, hydrogensulfate, silicate, hydroxide and the like, while not limited only to these disclosed, and at least two of these inorganic compounds may be coexistently fixed within the wood material. For elements forming cation part of the inorganic substance, such alkali earth metal element as magnesium (Mg), calcium (Ca), barium (Ba) or the like, zinc (Zn), aluminum (Al) or the like should preferably be employed while not required to be limited thereto, and such transition element as manganese (Mn), nickel (Ni), cadmium (Cd) or the like or such carbon group element as silicon (Si), lead (Pb) or the like may be utilized. For elements forming anion part, boric acid ions (including $BO_3$, $B_4O_7$ and $BO_2$), phosphoric acid ions (including $PO_4$, $HPO_4$ and $H_2PO_4$), hydroxide ions (OH), silicic acid ions (including $SiO_4$ and $SiO_3$) and the like may preferably be employed, while not limited thereto. Optimumly, the fire retardancy effect can be improved with a use of the $BO_3$ or $PO_4$ anions due to their promotion of carbonization, the $BO_3$ ions being caused to melt upon combustion to cover wood surface for rendering it to be non-flammable, with a use of $CO_3$ anions due to generation of non-flammable gas. Further, F, Cl or Br may also be employed and, with the use of these anions, the fire retardancy effect can be optimumly improved due to prevention of fire spreading and generation of the non-flammable gas.

Further, the cation-containing and anion-containing inorganic substances may be employed respectively alone or in a plurality which can be combined, in the latter event of which a plurality of the cation-containing or anion-containing inorganic substances are dissolved into water to prepare an inorganic substance solution containing cations or anions. In other words, the inorganic substance solutions may be obtained by employing the inorganic substances in such combination, when the cation-containing inorganic substances are CIS, $CIS_1$, $CIS_2$, . . . while the anion-containing inorganic substances are AIS, $AIS_1$, $AIS_2$, . . . , that CIS and AIS; CIS, $CIS_1$. . . and AIS; CIS and AIS, $AIS_1$. CIS, $CIS_1$. . . and AIS, $AIS_1$. . . ; and so on.

In initially impregnating the wood material with the inorganic substance solutions according to the present invention, the impregnation is carried out within a vacuumed atmosphere, whereby an effective impregnation can be realized with respect to the wood material without requiring such preliminary treatment for the water saturation of the wood material as in the know method.

In the vacuum impregnation, air gaps in the interior of the wood material in dry state are vacuumed to be at a lower pressure so that the inorganic substance solution can quickly soak into the gaps. The dry state wood material can be thus employed as they stand, and it should be appreciated that the water saturation treatment heretofore required can be omitted to be remarkably advantageous both in time and economy.

In practice, the vacuum impregnation is performed by, for example, fixing the wood material within a vacuum container, thereafter vacuuming the interior of the container to a predetermined level, leaving the wood material under the vacuumed state within the container for about 30 minutes, and pouring the inorganic substance solution containing either cations or anions into the vacuumed container. When the wood material is completely impregnated with this first solution poured, the atmospheric pressure is restored in the vacuum container. It is preferable that, for the impregnation efficiency, the vacuuming level is set to be less than 50 mmHg. It may be also possible that the first inorganic substance solution is initially poured into the vacuum container, the wood material is immersed into the solution within the container, and thereafter the interior of the container is vacuumed to the predetermined level. Then, the second water-soluble inorganic substance solution AIS or CIS other than the solution CIS or AIS with which the wood material has been impregnated immediately before is poured into the container to have the wood material impregnated with the second solution. In this manner, the impregnation is performed as repeated at least three times. While the immersing time of the wood material into the respective solutions is not required to be specifically limited, it is preferable that the immersing time is sequentially prolonged after, for example, the second impregnation and the following, so that the ion solutions will be effectively diffused into the wood material for sufficient production of the insoluble, non-flammable inorganic composition.

A modified wood can be obtained, as has been referred to in the above, by immersing the wood material alternately into the cation-containing and anion-containing inorganic substance solutions for such predetermined times as at least three times, and thereafter drying the material sufficiently. In this case, it may be also possible to perform, as an after-treatment of the immersing treatment, an eluviation, rinsing or the like treatment. It should be easily appreciated that, according to the modified wood manufacturing method of the present invention, the wood material can be impregnated with a relatively large amount of the insoluble, non-flammable inorganic compound.

It has been found, on the other hand, that the cation-containing or anion-containing inorganic solution employed for the first impregnation of the wood material during the impregnating steps repeated at least three times should optimumly be of a solubility to water in particular of 100 g at 25° C. is more than 5 g (which shall be hereinafter referred to simply as "solubility 5"). As the cation-containing inorganic substance of more than the solubility 5, there may be enumerated such substances, shown with the solubility as parenthesized, as calcium chloride (45.3), magnesium chloride (35.5), sodium bromide (48.61), potassium bromide (40.0) and the like and, as the anion-containing inorganic substance, there may be enumerated such substances, also shown with the solubility as parenthesized, as potassium carbonate (52.85), diammonium hydrogen phosphate (41.0), ammonium sulfate (43.3) and the like, though not required to be limited thereto.

It is preferred that the solution employed for the third immersion is made higher in concentration than that used for the first immersion. Specifically at the final impregnation of the wood material in the impregnating step repeated at least three times according to the present invention, further, it is preferable to employ an anion-containing inorganic substance solution of a high concentration for immersing therein and impregnation therewith of the wood material. When the high concentration anion-containing inorganic substance solution is used previously for the last repeated impregnation, the diffusion rate of anions into the wood material is accelerated so that cation component already contained in the wood material will be thereby caused to react with anions within the material without flowing thereout. Accordingly, it can be ensured that the insoluble, non-flammable inorganic compound is restrained from being produced outside the wood material, but the diffusion and fixation of a larger amount of the insoluble, non-flammable inorganic substance within the wood material are carried out highly efficiently. The immersing bath can be thereby prevented from being contaminated so as to be repetitively utilizable for highly efficient utilization of the inorganic substance, and the economy of the method can be improved to a large extent. In an event where ions which have not reacted with each other are to remain inside the wood material, anion component is caused to be the residue. Since the anion component shows higher fire properties than cation component, the residue is capable of improving the non-flammability provided to the wood material, and any eluviation normally required as an after-treatment of the impregnation can be made unnecessary. With the high concentration anion-containing inorganic substance solution, a rinse action can be attained with respect to any insoluble, non-flammable inorganic substance deposited on the surface of the wood material to be likely to impair the appearance and texture of wood, so that the surface of the modified wood material can be made to maintain natural wood appearance and texture, without requiring any separate rinsing step.

Practical examples of the present invention as well as comparative examples shall be described in the followings:

EXAMPLE 1

Rotary-lathed single ply, 3 mm thick wood plates of agatis were immersed into water for saturation treatment under vacuumed condition below 30 Torr to be more than 150% in water content, then into a cation-containing inorganic substance solution (as first time bath) of a mixture of 2.0 mol $BaCl_2$ and 2.0 mol $H_3BO_3$ per 1 lit. of water, thereafter into an anion-containing inorganic substance solution (as second time bath) of a mixture of 4.0 mol $(NH_4)_2HPO_4$ and 6.0 mol $H_3BO_3$ per 1 lit. of water, and finally in the same solution (as third time bath) as that of the first time bath, the plates were thereafter rinsed, and dried to obtain modified wood materials.

EXAMPLES 2 through 6

The same wood plates as in Example 1 were subjected to similar immersing into the first to third baths as in Example 1 but respectively with such inorganic substances as shown in following TABLE 1, respectively with such inorganic substances as listed in respective columns of Examples 2 through 6 at mol concentrations shown as parenthesized immediately following the inorganic substances.

Modified wood plates obtained through these Examples have shown that 90–130 of the insoluble, non-flammable inorganic compound was formed as a composite with respect to the absolute dry weight 100 of the wood material, and the wood plates were made to contain therein a large amount of the insoluble, non-flammable inorganic compound at a high efficiency. The modified wood plates obtained were subjected to measurements for determining respective properties of the mothproofness by means of insect's death rate (%) in three weeks as provided by JWPA Standard, No. 11, rotproofness by means of decreased-weight percentage (%) in 6 weeks as provided by JWPA Standard, No. 1, non-flammability Grade II by means of non-flammability in 10 minutes of burning as provided by JIS Standard A 1321, dynamic strength by means of three-points bending at 17 mm LVL, $Kg/cm^2$ of JIS Z 2113, and dimensional stability by means of swelling resistance (or shrinkage resistance) ASE, results of which measurements were also as shown in the following TABLE 1, in which similar measurement data carried out with respect to non-modified and modified wood plate as Comparative Examples 1 through 3 were included:

TABLE I

| | EX. 1 | EX. 2 | EX. 3 | EX. 4 | EX. 5 | EX. 6 | COMP. EX. 1 | COMP. EX. 2 | COMP. EX. 3 |
|---|---|---|---|---|---|---|---|---|---|
| 1st Bath | $BaCl_2$(2.0)<br>$H_3BO_3$(2.0) | "(2.0)<br>"(2.0) | $ZnCl_2$(4.0)<br>"(1.0) | "(2.0)<br>"(2.0) | "(2.0)<br>"(2.0) | "(2.0)<br>— | — | $BaCl_2$(2.0)<br>— | "(2.0)<br>$H_3BO_3$(2.0) |
| 2nd Bath | $(NH_4)_2HPO_4$(4.0)<br>$H_3BO_3$(6.0) | "(4.0)<br>"(6.0) | "(8.0)<br>"(6.0) | $Na_3HOP_4$(4.0)<br>"(6.0) | "(4.0)<br>"(6.0) | "(4.0)<br>— | — | $(NH_4)_2HPO_4$(4.0)<br>— | "(4.0)<br>$H_3BO_3$(6.0) |
| 3rd Bath | $BaCl_2$(2.0)<br>$H_3BO_3$(2.0) | $ZnCl_2$(4.0)<br>"(1.0) | "(4.0)<br>"(1.0) | $BaCl_2$(2.0)<br>"(2.0) | $ZnCl_2$(4.0)<br>"(2.0) | $BaCl_2$(2.0)<br>— | — | — | — |
| Total Pickup (%) of Inorg. Subst. | 100–110 | 110–120 | 120–130 | 90–100 | 110–120 | 80–90 | — | 60–70 | 70–80 |
| Mothproof (%) | 100 | 100 | 100 | 100 | 100 | 100 | 20 | 100 | 100 |
| Rotproof (%) | 8 | 7 | 5 | 10 | 12 | — | 44 | — | 15 |
| Non-flammability | G | VG–G | VG–G | G | G | B | B | G–B | |
| Bend. Strength ($kg/cm^2$) | 800 | 850 | 900 | 800 | 800 | 850 | 800 | 750 | 850 |
| Dimens. Stab. (ASE) | 40 | 50 | 60 | 50 | 60 | 40 | — | 30 | 40 |

EXAMPLE 7

A rotary-lathed single ply plate of hemlock of 3 mm thick was immersed into water for water saturation under vacuumed condition below 30 Torr to be water content of more than 150%, then into an anion-containing inorganic substance solution (as first bath) of a mixture of 3.5 mol of $(NH_4)_2HPO_4$ and 4.0 mol of $H_3BO_3$ per 1 lit. of water for 24 hours, thereafter into a cation-containing inorganic substance solution (as second bath) of a mixture of 2.0 mol of $BaCl_2$ and 2.0 mol of $H_3BO_3$ per 1 lit. of water for 24 hours, and finally in a further anion-containing inorganic substance solution (as third bath) of a mixture of 4.0 mol of $(NH_4)_2HPO_4$ and 6.0 mol of $H_3BO_3$ per 1 lit. of water, and thereafter the plate was rinsed and dried to obtain a modified wood material.

EXAMPLES 8 through 12

The same wood plates as in Example 6 were subjected to the immersing with the first to third baths under the same time condition as in EXAMPLE 6, the baths having been prepared with such inorganic substances as listed in following TABLE II at columns of EXAMPLES 8 through 12 at mol concentration shown as parenthesized immediately after the substances.

COMPARATIVE EXAMPLES 4 through 6

The wood plates were subjected to the similar repetitive bath immersing to that in EXAMPLES 7 through 12, the baths having been prepared with such inorganic substances as listed in the TABLE II at columns of COMPARATIVE EXAMPLES 4 through 6 respectively at mol concentration shown as parenthesized immediately after the substances.

The modified wood materials obtained through these Examples were subjected to measurements of the total impregnation coefficient (%) of the inorganic substance and the non-flammability, and their appearance was observed, results of which were as shown also in TABLE II with indications of the non-flammability by that under JIS Standard A 1321, Class II as VG, Class III as B and intermediate between Classes II and III as G, and of the appearance by VG for the wood material on the surface of which no inorganic compound produced was observed, B for that rendered to be white by produced inorganic compound, and G for that intermediate between VG and B:

TABLE II

| | EXAMPLE 7 | EX. 8 | EX. 9 | EX. 10 | EX. 11 | EX. 12 | COMP. EX. 4 | C. EX. 5 | C. EX. 6 |
|---|---|---|---|---|---|---|---|---|---|
| 1st Bath | $(NH_4)_2HPO_4$(3.5)<br>$H_3BO_3$ (4.0) | "(3.5)<br>"(4.0) | "(3.5)<br>$Na_2B_4O_7$(2.0) | "(3.5)<br>$H_3BO_3$ (4.0) | $BaCl_2$ (2.0)<br>"(2.0) | $(NH_4)_2HPO_4$(3.5)<br>— | "<br>$H_3BO_3$ (6.0) | "(3.5)<br>"(4.0) | $BaCl_2$(2.0)<br>"(2.0) |
| 2nd Bath | $BaCl_2$ (2.0)<br>$H_3BO_3$ (2.0) | "(2.0)<br>"(2.0) | "(2.0)<br>$Na_2B_4O_7$(1.0) | $ZnCl_2$ (4.0)<br>$H_3BO_3$ (6.0) | $(NH_4)_2HPO_4$(3.5)<br>"(4.0) | $BaCl_2$ (2.0)<br>— | "(2.0)<br>$H_3BO_3$ (2.0) | "(2.0)<br>"(2.0) | $(NH_4)_2HPO_4$(3.5)<br>"(4.0) |
| 3rd Bath | $(NH_4)_2HPO_4$(4.0)<br>$H_3BO_3$ (6.0) | "(8.0)<br>"(6.0) | "(8.0)*<br>$Na_2B_4O_7$(4.0) | "(8.0)<br>$H_3BO_3$ (6.0) | "(2.0)<br>"(2.0) | $(NH_4)_2HPO_4$(8.0)<br>— | — | $(NH_4)_2HPO_4$(3.5)<br>$H_3BO_3$ (4.0) | $BaCl_2$ (2.0)<br>"(2.0) |
| 4th Bath | — | — | — | — | $(NH_4)_2HPO_4$(8.0)*<br>$H_3BO_3$ (6.0) | — | — | — | — |
| Total Pickup (%) of Inorg. Subst. | 120–130 | 130–140 | 130–140 | 130–140 | 190–200 | 110–120 | 90–100 | 100–110 | 110–120 |
| Non-flammability | VG–G | VG | VG | VG–G | VG | VG–G | G–B | G | G |
| Appearance | G | VG | VG–G | VG–G | VG–G | G | B | G–B | G–B |

*In TABLE II, fourth bath immersing of EXAMPLE 11 was carried out for 24 hours, while only third bath immersing of EXAMPLE 9 was for 12 hours.

EXAMPLE 13

A rotary-lathed single ply wood plate of hemlock of 3 mm thick was placed in a vacuum container, the interior of the container was vacuumed by 30mmHg, the plate was therein immersed for 1 hour in a first bath of anion-containing inorganic substance solution prepared by mixing 3.5 mol of $(NH_4)_2HPO_4$ and 4.0 mol of $H_3BO_3$ per 1 lit. of water, thereafter immersed for 6 hours in a second bath of cation-containing inorganic substance solution prepared by mixing 2.0 mol of $BaCl_2$ with 2.0 mol of $H_3BO_3$ per 1 lit. of water, and finally immersed for 17 hours in a third bath of anion-containing inorganic substance solution prepared by mixing 8.0 mol of $(NH_4)_2HPO_4$ with 6.0 mol of $H_3BO_3$ per 1 lit. of water. The plate was thereafter dried to obtain a modified wood material.

EXAMPLES 14 through 17

The same sort of the hemlock plates as in EXAMPLE 13 were subjected to the same immersings repeated with the first to third baths respectively of such inorganic substances as shown in following TABLE III, respective columns of EXAMPLES 14 through 17, with mol concentration indicated as parenthesized immediately after the inorganic substances, and with immersing time shown also in the respective columns.

COMPARATIVE EXAMPLES 7 through 9

The same sort of the hemlock plates as in EXAMPLE 13 were preliminarily subjected, as a before-treatment, to water saturation for 72 hours, and thereby water-saturated plates were then immersed two or three times in the same manner as in EXAMPLES 13 through 17, respective baths of which were of such inorganic substances as in columns of COMPARATIVE EXAMPLES 7 through 9, with mol concentration and immersing time likewise indicated in the following TABLE III.

As will be clear from the respective TABLES I, II and III, it will be appreciated that the modified wood material according to the present invention requires only much shorter treating time than that for the respective Comparative Examples and still is excellent in the mothproof and rotproof properties but also in the non-flammability and appearance. The wood material is also hardened sufficiently by the larger amount of insoluble, non-flammable inorganic compound highly efficiently diffused and fixed in the wood material, so that such raw woods as coniferous trees which are of a relatively soft structure can be improved in the non-flammability and also increased in the hardness. With the vacuum immersing employed, further, it has been empirically proved that the impregnation even of veneers of more than 1mm thick can be effectively achieved with the inorganic substance solutions, the sufficient diffusion and impregnation of which can even be attained with respect to thicker veneers reaching 15 mm, for fixation therein of the insoluble, non-flammable inorganic compound.

TABLE III

| | EXAMPLE 13 | EX. 14 | EX. 15 | EX. 16 | EX. 17 | COMP. EX. 7 | C. EX. 8 | C. EX. 9 |
|---|---|---|---|---|---|---|---|---|
| 1st Bath | $(NH_4)_2HPO_4$(3.5) | "(3.5) | "(1.75) | "(2.675) | $BaCl_2$(2.0) | $(NH_4)_2HPO_4$ (3.5) | "(3.5) | $BaCl_2$(2.0) |
| | $H_3BO_3$ (4.0) | "(4.0) | "(2.0) | "(3.0) | "(2.0) | "(4.0) | "(4.0) | "(2.0) |
| Hours | 1 | 1 | 1 | 1 | 1 | 24 | 1 | 24 |
| 2nd Bath | $BaCl_2$ (2.0) | "(2.0) | "(2.0) | "(2.0) | $(NH_4)_2HPO_4$(3.5) | $BaCl_2$ (2.0) | "(2.0) | $(NH_4)_2HPO_4$(3.5) |
| | $H_3BO_3$ (2.0) | "(2.0) | "(2.0) | "(2.0) | "(4.0) | "(2.0) | "(2.0) | "(4.0) |
| Hours | 6 | 5 | 4 | 4 | 3 | 24 | 4 | 24 |
| 3rd Bath | $(NH_4)_2HPO_4$(8.0) | "(4.0) | "(3.5) | "(3.5) | $BaCl_2$ (2.0) | $(NH_4)_2HPO_4$ (3.5) | "(3.5) | — |
| | $H_3BO_3$ (2.0) | "(6.0) | "(4.0) | "(4.0) | "(2.0) | "(4.0) | "(4.0) | |
| Hours | 17 | 5 | 4 | 4 | 3 | 24 | 4 | |
| 4th Bath | — | — | — | — | $(NH_4)_2HPO_4$(8.0) | — | — | — |
| | | | | | $H_3BO_3$ (6.0) | | | |
| Hours | | | | | 3 | | | |
| Total Hrs. | 24 | 11 | 9 | 9 | 10 | 144 | 81 | 120 |
| Total Pickup (%) of Inorg. Subst. | 130–140 | 100–110 | 95–110 | 105–120 | 120–130 | 110–120 | 85–95 | 110–120 |
| Non-flammability* | VG | VG–G | VG–G | VG–G | VG–G | G | B | G |
| Appearance* | VG | VG–G | VG | VG–G | VG–G | G–B | G–B | B |

*In this TABLE III, the non-flammability and appearance are indicated in the same manner as in TABLE II.

What we claim as our invention is:

1. A method for making a modified wood material, comprising alternately immersing a raw wood material in two types of solutions, a cation-containing solution and an anion-containing solution, the cations and anions being such as to form a non-flammable, water-insoluble, inorganic compound within the raw wood material, wherein said raw wood material is alternately immersed a total of at least three times in one of said two types of solutions and then in the other of said two types of solution and wherein the solution employed for the third immersing is made higher in concentration than that used for the first immersing.

2. A method according to claim 1, wherein said cation-containing solution includes at least one cation selected from the group consisting of magnesium, aluminum, calcium, zinc and barium ions, and said anion-containing solution includes at least one anion selected from the group consisting of carbonic acid ions, silicic acid ions, sulfuric acid ions, phosphoric acid ions, boric acid ions and hydroxide ions.

3. A method according to claim 1, wherein a first one of the three total immersings is carried out under vacuum.

4. A method according to claim 1, wherein the solutions used for the first and third immersings are of the same ions.

5. A method according to claim 4, wherein an anion-containing solution is used for the first and third immersing.

6. A method according to claim 1, wherein at least one of said two types of solutions contains at least one member selected from the group consisting of boric acid and sodium borate.

7. A method according to claim 1, wherein said two types of solutions are prepared with water-soluble inorganic substances the solubility of which is selected to be more than 5 g with respect to 100 g of water at 25° C.

* * * * *